United States Patent [19]

Fortenberry

[11] Patent Number: 4,630,746

[45] Date of Patent: Dec. 23, 1986

[54] COLLAPSIBLE STACKABLE SHIPPING CONTAINER

[75] Inventor: Jerry B. Fortenberry, Northville, Mich.

[73] Assignee: Fortenberry & Associates, Inc., Northville, Mich.

[21] Appl. No.: 584,091

[22] Filed: Feb. 27, 1984

[51] Int. Cl.[4] ..... B65D 7/24

[52] U.S. Cl. ..... 220/6; 220/1.5

[58] Field of Search ..... 220/1.5, 6, 19; 206/511, 512

[56] References Cited

U.S. PATENT DOCUMENTS

| | | | |
|---|---|---|---|
| 2,224,310 | 12/1940 | Merrett et al. | 5/99 |
| 3,003,647 | 10/1961 | Lockwood . | |
| 3,086,660 | 4/1963 | Steele . | |
| 3,193,093 | 7/1965 | Hansen . | |
| 3,246,927 | 4/1966 | Klassen . | |
| 3,383,003 | 5/1968 | Schurch . | |
| 3,400,671 | 9/1968 | Erismann . | |
| 3,446,415 | 5/1969 | Bromley | 220/7 X |
| 3,478,914 | 11/1969 | Williams . | |
| 3,565,018 | 2/1971 | Joy . | |
| 3,675,815 | 7/1972 | Rehrig | 206/512 X |
| 3,762,343 | 10/1973 | Thacker . | |
| 3,796,342 | 3/1974 | Sanders et al. | 220/1.5 X |
| 3,857,494 | 12/1974 | Giardini . | |
| 3,865,269 | 2/1975 | Coleman | 220/1.5 X |
| 3,870,185 | 3/1975 | Sanders et al. | 220/6 |
| 3,874,546 | 4/1975 | Sanders et al. | 220/6 |
| 3,981,410 | 9/1976 | Schurch . | |
| 4,043,476 | 8/1977 | Joseph | 220/19 |
| 4,120,417 | 10/1978 | Aquino | 220/6 |
| 4,235,345 | 11/1980 | Vandedrink et al. | 220/6 |
| 4,320,845 | 3/1982 | Waller | 220/6 |
| 4,375,265 | 3/1983 | van de Wetering et al. | 220/1.5 |
| 4,491,231 | 1/1985 | Heggeland et al. | 220/6 |

FOREIGN PATENT DOCUMENTS

| | | | |
|---|---|---|---|
| 224243 | of 1958 | Australia . | |
| 1048423 | 2/1979 | Canada | 220/7 |
| 2268700 | 11/1975 | France | 220/7 |
| 956430 | of 1964 | United Kingdom . | |

*Primary Examiner*—Steven M. Pollard

*Attorney, Agent, or Firm*—Cullen, Sloman, Cantor, Grauer, Scott & Rutherford

[57] ABSTRACT

A collapsible stackable shipping or storage container comprises front and rear walls and opposed sectional end walls, each end wall including a pair of aligned end wall sections pivotally interconnected and at their outer edges pivotally connected to the front and rear walls. A pair of bottom walls at their outer edges are pivotally connected to the front and rear walls and are supported upon the interior of the end wall sections. All of the walls and sections including the hinge connections are of a molded plastic material and includes a series of right angularly related reinforced ribs to define an open mesh.

18 Claims, 15 Drawing Figures

11
13
37
43
53
47
51
45
17
35
36
38
39
41
21
25
75
19
49

COLLAPSIBLE STACKABLE SHIPPING CONTAINER

BACKGROUND OF THE INVENTION

1. Field of Use

The present invention is directed to storage and shipping containers and particularly to a collapsible, stackable shipping or storage container wherein the respective front and rear, side and bottom walls are so pivotally connected that the complete assembly may be collapsed for storage or transport.

2. The Prior Art

Illustrative of the prior art are the following identified United States Patents:

| U.S. PAT. NO. | NAME | DATE |
|---|---|---|
| 2,735,568 | D. H. Bitney | February 21, 1956 |
| 2,776,775 | C. C. Averhill | January 8, 1957 |
| 2,793,780 | M. D. Walklet et al | May 28, 1957 |
| 3,981,410 | Richard C. Schurch | September 21, 1976 |

Heretofore, various types of shipping containers have been provided of an open wire mesh construction wherein different methods have been employed for hingedly interconnecting the respective walls, sides and bottoms. Some of the prior art shipping containers are collapsible when not in use. Other shipping containers are made from metal or wood panels.

SUMMARY OF THE INVENTION

An important feature of the present invention is to provide an improved collapsible, stackable storage or shipping container which is constructed essentially from plastic material and wherein each of the respective wall elements and the corresponding hinge portions thereof are integrally molded.

Another feature is to provide a collapsible, stackable shipping or storage container which includes upright front and rear walls, a pair of opposed sectional end walls, with each end wall including a pair of aligned end wall sections pivotally interconnected and at their outer upright edges pivotally connected to the corresponding edges of the front and rear walls, and wherein a pair of aligned bottom walls at their outer edges are pivotally connected to the front and rear walls with their opposite sides supported upon the end walls.

Still another feature of the shipping or storage container is to provide ledges upon the interior of the opposed pivotally interconnected side wall sections which are adapted to support the bottom walls in a horizontal use position.

A further feature of the shipping or storage container contemplates the collapsing of the shipping container by first elevating the bottom walls into engagement with the front and rear walls and successively collapsing the end wall sections inwardly so that the corresponding end wall sections are in engagement and at the same time bringing the front and rear walls and the bottom walls bearing thereon into a compact collapsed engagement.

A still further feature of the shipping or storage container includes the provision upon the front and rear walls of an access section or door positioned within an opening in the upper portion thereof which is pivotally connected to the corresponding wall at one edge and adjacent its upper edge there is provided a pair of oppositely directed latch assemblies adapted to move into interlocking engagement with adjacent portions of the wall. When the latch assemblies are retracted the corresponding access sections of the front and rear walls may be rotated downwardly into engagement with the corresponding wall.

Another feature of the shipping or storage container includes a plurality of legs molded as an integral part of the corresponding walls or wall sections and depending therefrom.

Still another feature of the shipping or storage container contemplates the molding of the corresponding front wall, rear wall, end wall sections and bottom walls from a plastic material to provide therein a plurality of closely spaced right angularly related ribs thereby defining an open mesh or honeycomb construction for minimum weight and maximum strength for the container.

As a further feature of the shipping or storage container, the legs which depend from opposite ends of the front and rear walls of the container have undercut notched and tapered guide portions and stops which are adapted to cooperatively and supportably receive the upwardly extending tapered keys projecting from an underlying container. A second container is snugly nested over and is stacked on the first container. A third container may also be nested with the upper or second container.

A further feature of the shipping or storage container contemplates the formation of the corner legs of the front and rear walls of the container such that when a second container is stacked thereover, the corresponding tapered and stop formations of one container will cooperatively and interlockingly engage corresponding upwardly extending key assemblies projecting from upper end portions of the front walls of an underlying container.

Another important feature of the shipping or storage container contemplates the respective walls, end sections and corresponding hinge elements by which the sections are pivotally connected are all formed of a molded plastic material and wherein each of the corresponding adjacent pivotally connected walls or wall sections and their corresponding aligned hinge elements are interconnected by transverse pivot pins of plastic or metal.

Still another feature of the shipping or storage container is to provide a modular assembly to facilitate replacement of any wall or wall section by the removal of one or two pivot pins.

These and other objects and features will be seen from the following specification and claims in conjunction with the appended drawings.

THE DRAWINGS

It will be understood that the above drawings illustrate merely a preferred embodiment of the invention and that other embodiments are contemplated within the scope of the claims hereafter set forth.

DETAILED DESCRIPTION OF AN EMBODIMENT OF THE INVENTION

Figure 1:
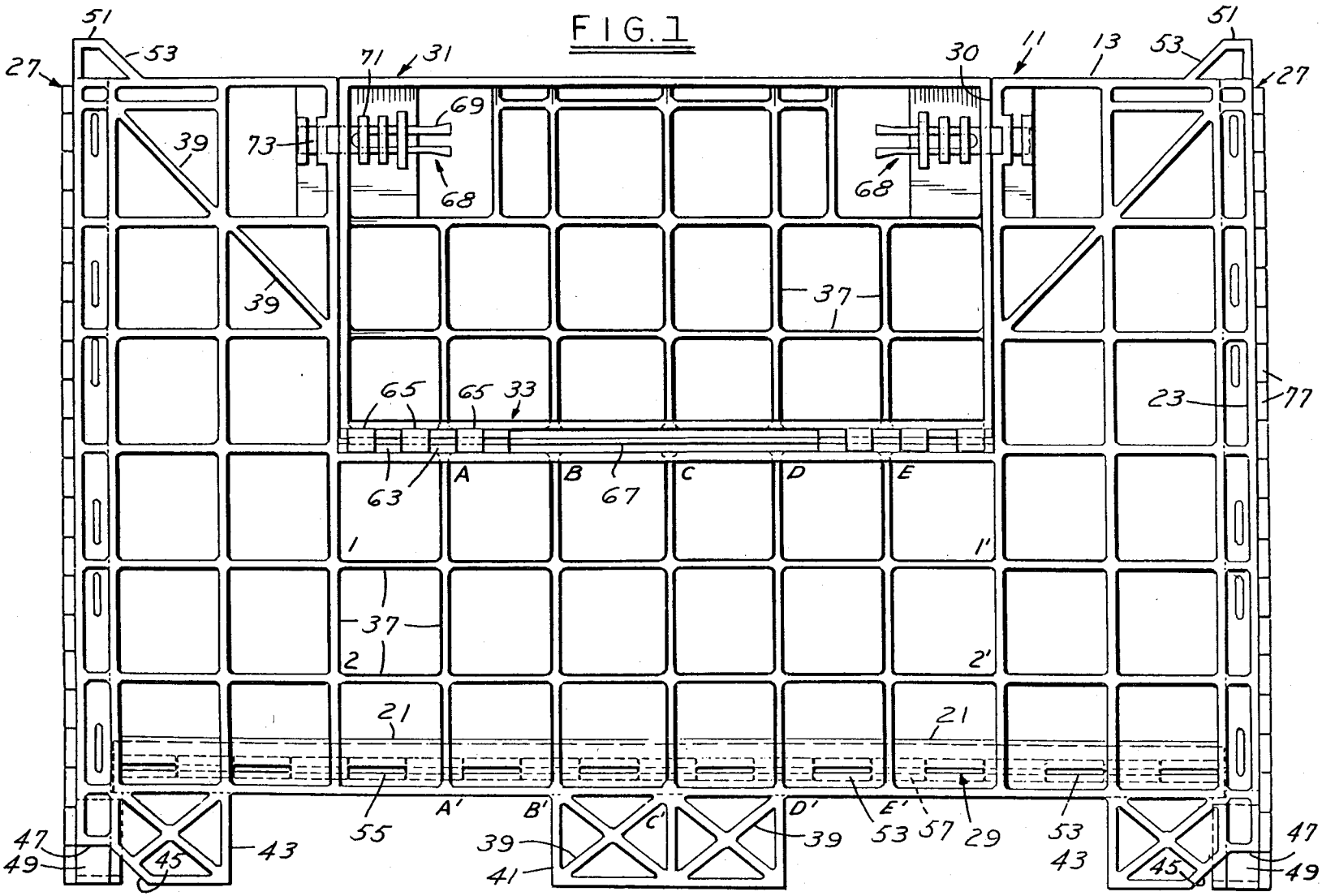
FIG. 1 is a elevational view of a front wall of the present shipping or storage container shown partly collapsed in FIG. 14.
Figure 14:
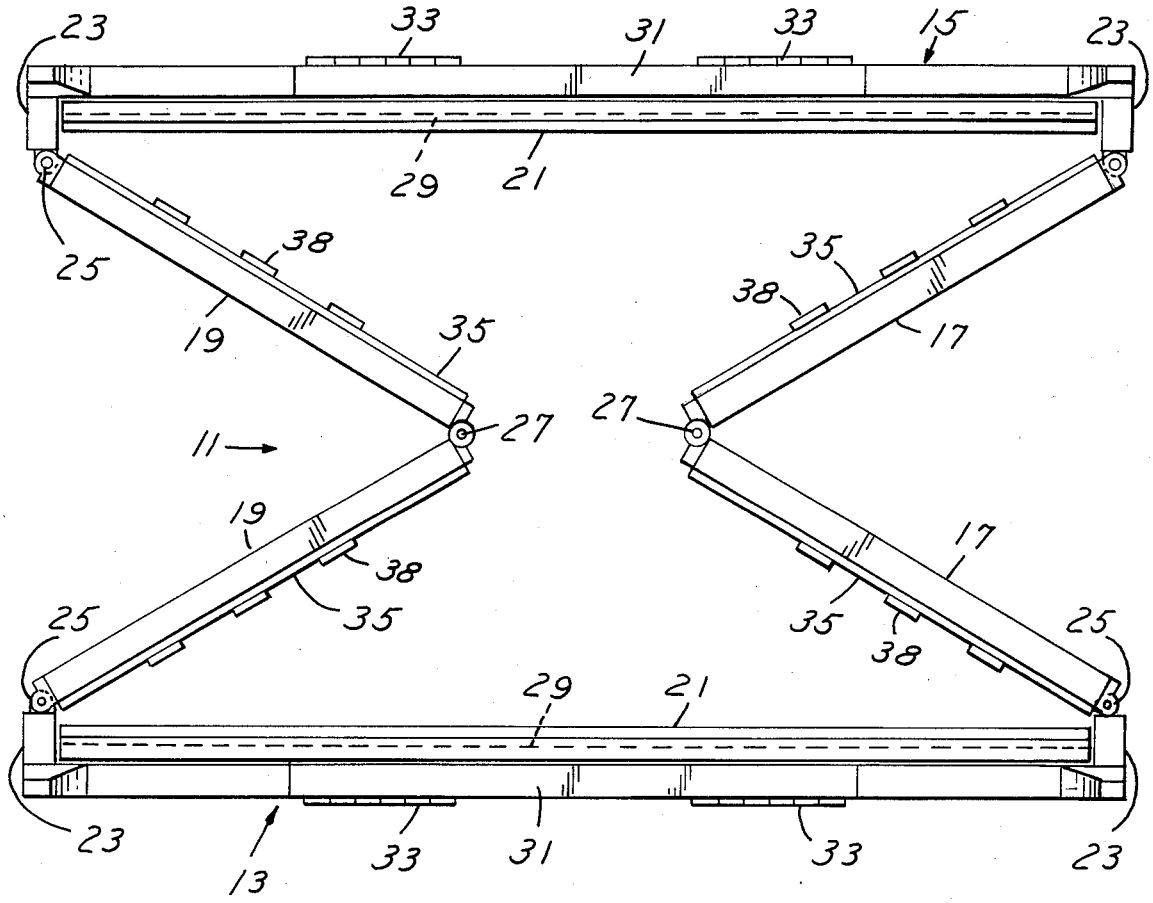
FIG. 14 is a plan view of the shipping container of FIG. 2 with the bottom walls collapsed and with the end wall sections and corresponding front and rear walls partly collapsed.

Referring to FIGS. 1 and 14, the present collapsible and stackable shipping or storage container is generally indicated at 11 and includes front wall 13, rear wall 15, and opposed sectional end walls, with each end wall including a pair of aligned end wall sections 17 and 19 respectively. The various wall panels of the container 11 are of modular, open mesh plastic construction for minimum weight and maximum strength as will be described herein.

Figure 2:
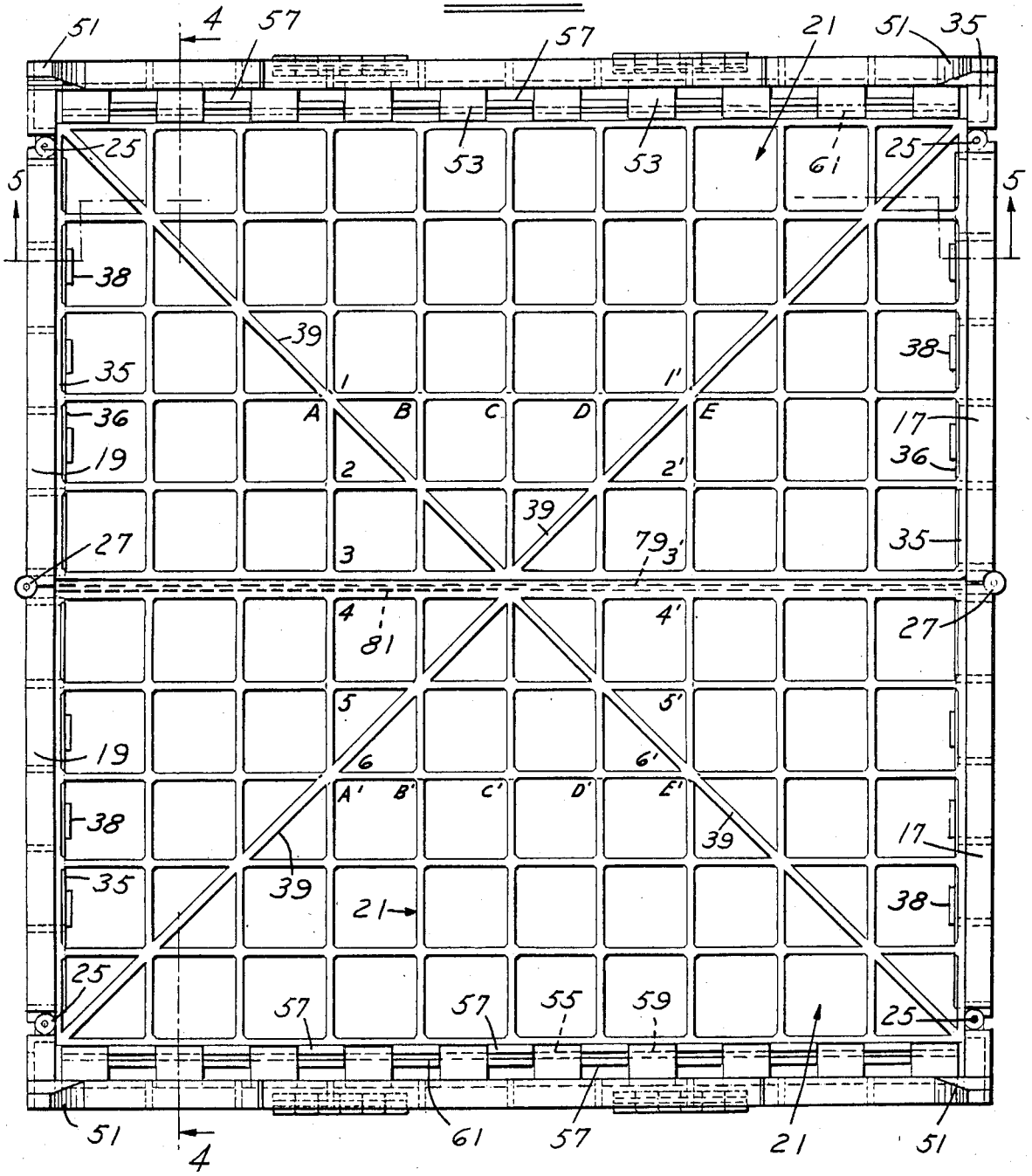
FIG. 2 is a plan view of the shipping or storage container.
Figure 4:
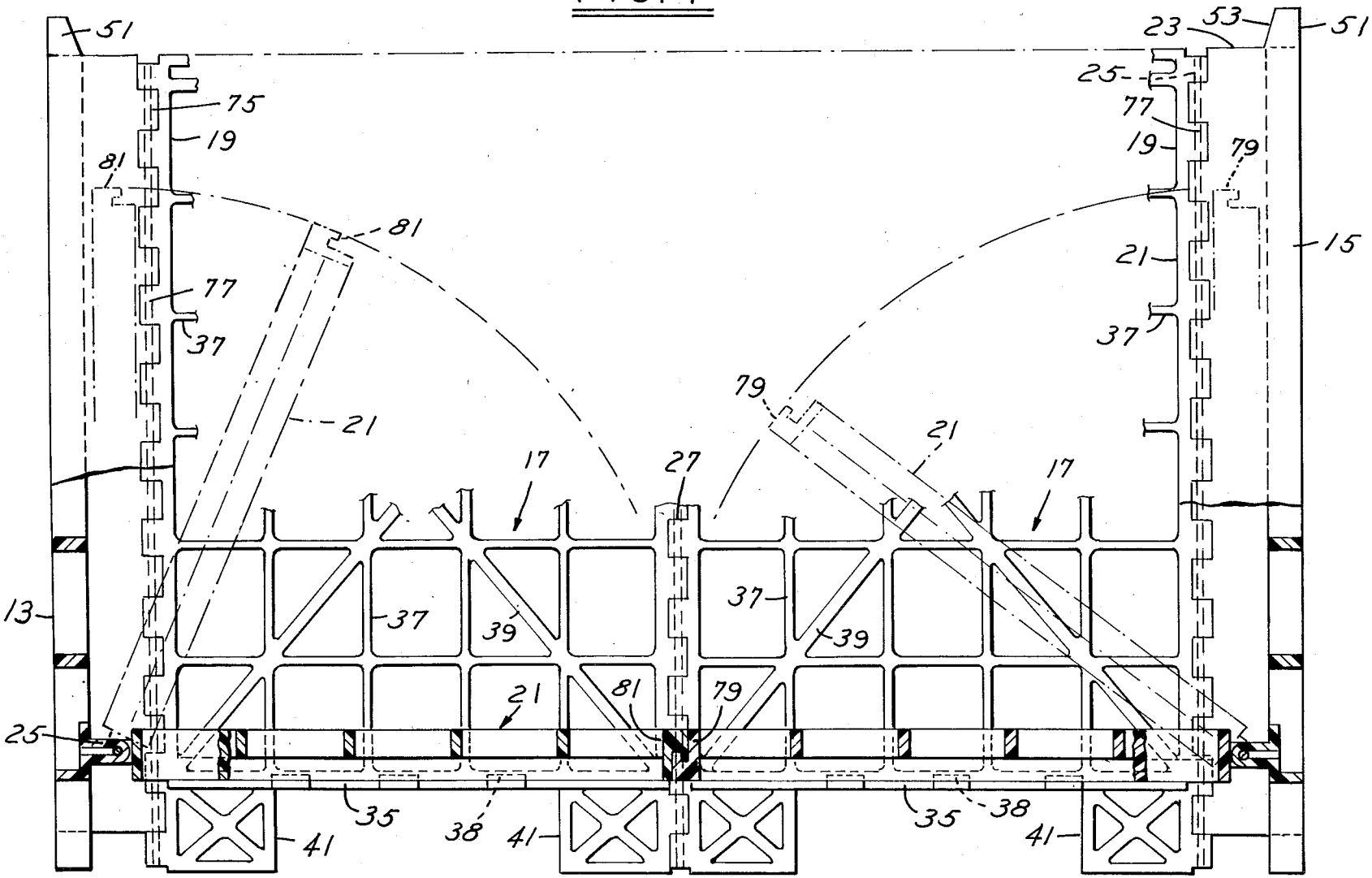
FIG. 4 is a fragmentary side elevational view, partly in section, taken in the direction of arrows 4—4 of FIG. 2, with the bottom walls or wall sections in registry with one another in a horizontal position and shown elevated by the dash lines in intermediate or raised positions.

A pair of aligned bottom walls or wall sections 21, FIGS. 2 and 4 are positioned between end wall sections 17 and 19, FIG. 2 and at their outer edges are pivotally connected by a bottom wall hinge pin 29 to the corresponding front and rear walls 13 and 15 respectively. Portions of the bottom walls 21 are supported upon interior shelves or ledges 35 of the corresponding end wall sections 17 and 19. The ledges 35 are located on the lower edge portions of the wall sections 17 and 19 as shown in FIGS. 2, 5 and 11–13. Each ledge 35, at the inner edge 36 thereof, is provided with a plurality of upstanding and longitudinally spaced apart locking tabs 38. With such a construction, the opposite sides of the bottom wall sections 21 are supportably positioned upon the ledges 35 throughout their horizontal extent and are retained or locked in position, by the tabs 38, as shown, in FIGS. 2, 4 and 5.

Formed upon upright outer edges of the front and rear walls 13 and 15, are the opposed corners or corner members 23 of L-shape configuration. Corners 23 extend inwardly of and at right angles to the corresponding front and rear walls 13, 15 and along their inner upright edges are hingedly connected by pivot pins 25 to the adjacent upright edges of the corresponding end wall sections 17 and 19, FIGS. 2 and 14.

Figure 7:
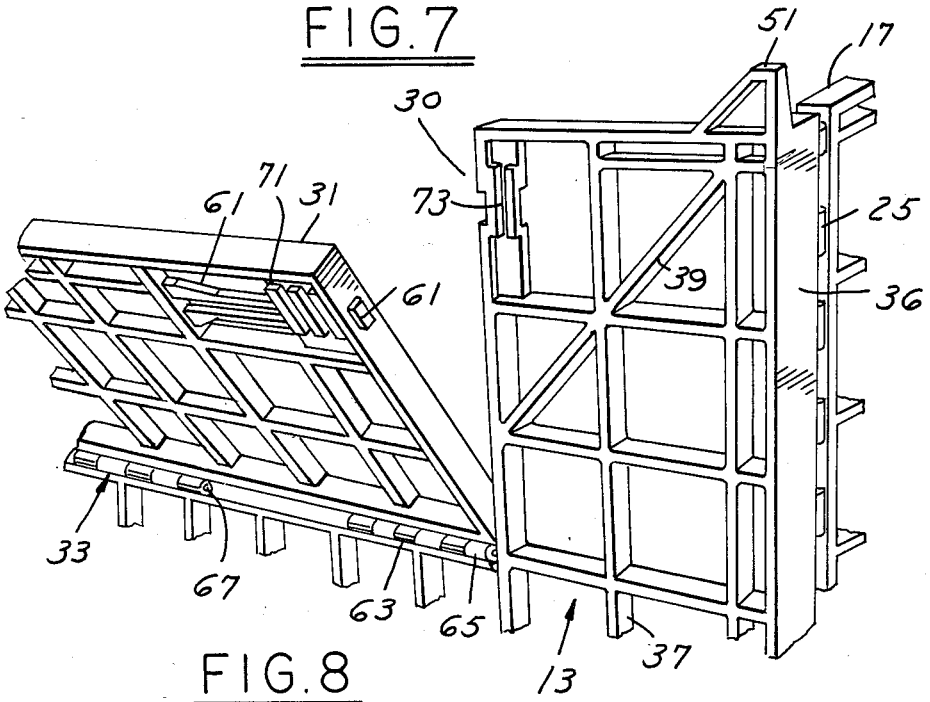
FIG. 7 is a fragmentary perspective view of a portion of the front wall of the shipping container with its access section or door partly pivoted out of the plane thereof.
Figure 8:
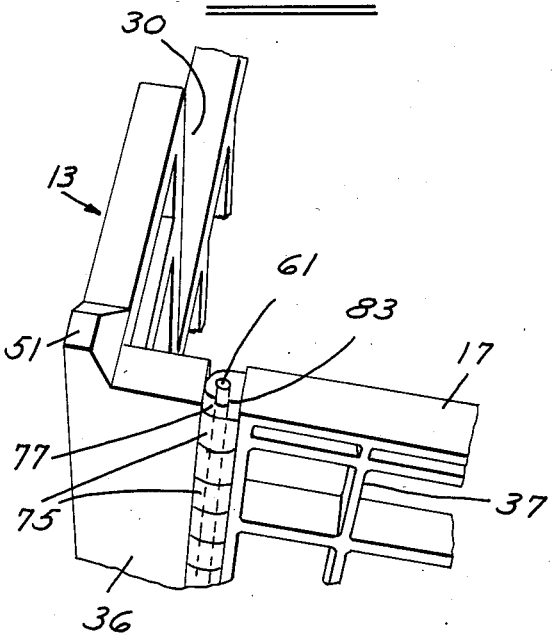
FIG. 8 is a top side perspective view of a portion of the front wall of the shipping container with one of the end wall sections fragmentarily shown and pivotally connected thereto.

The front and rear walls 13, 15 are provided with central rectangular openings 30 in the upper portions thereof as illustrated in FIGS. 1 and 7. Received in the openings 30 are front and rear access wall sections or doors 31 as shown in FIGS. 1 and 7. The doors 31 are normally nested within the openings 30 within the plane of the aforesaid walls and at their lower ends are pivotally connected to the corresponding front and rear walls 13, 15 by hinges 33.

Figure 9:
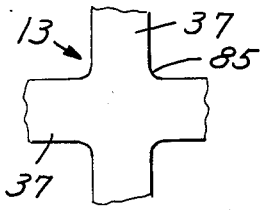
FIG. 9 is an elevational view on an enlarged scale illustrating the molded plastic intersecting ribs and typical reinforcing radii forming a part of the respective walls and sections.
Figure 11:
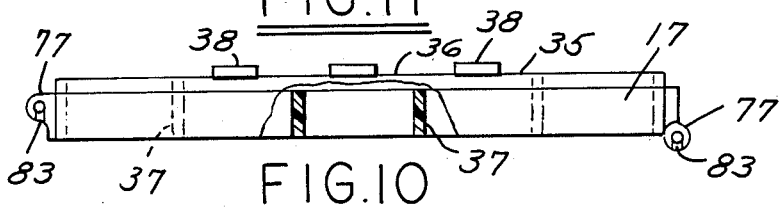
FIG. 11 is a plan view of the end wall section of FIG. 10.
Figure 10:
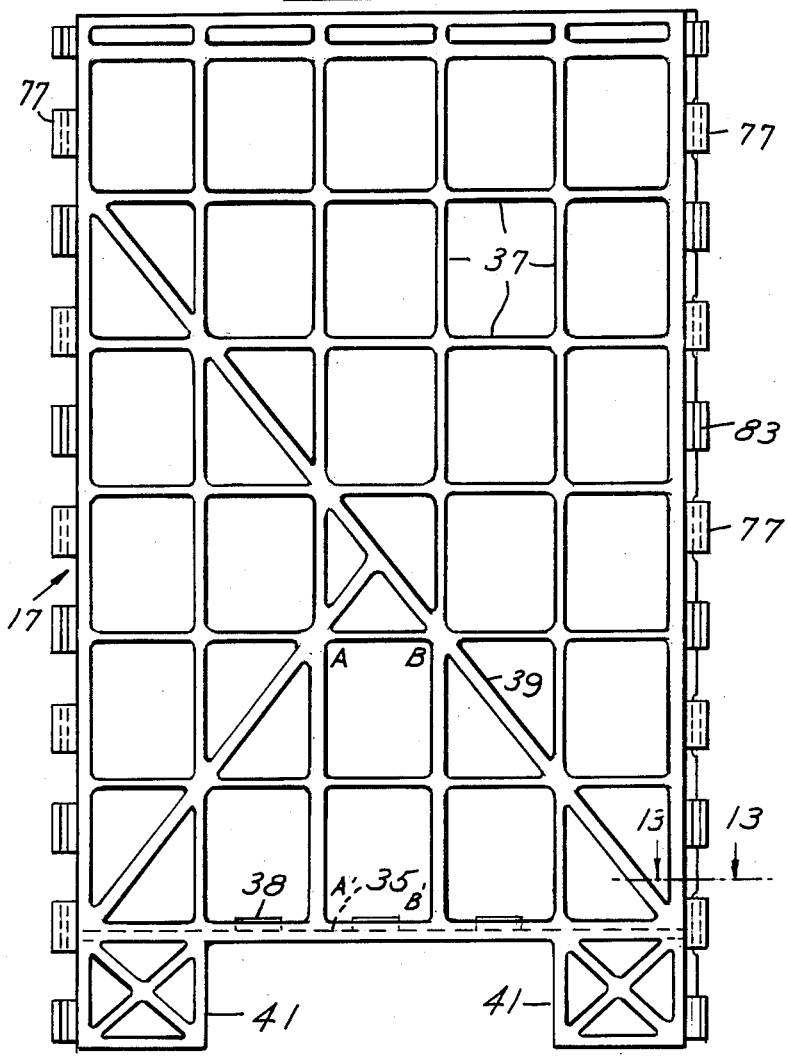
FIG. 10 is a side elevational view of one of the end wall sections shown in FIG. 3.
Figure 12:
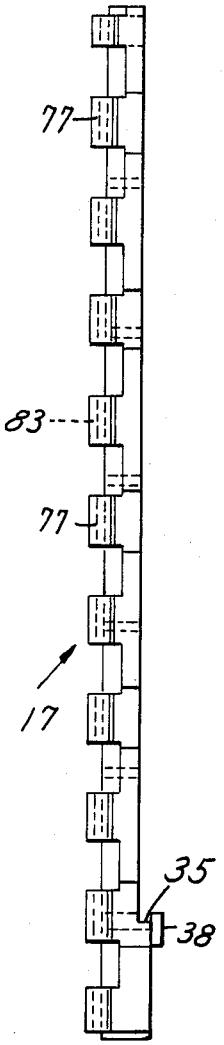
FIG. 12 is a right side elevational view of the end wall section.
Figure 13:
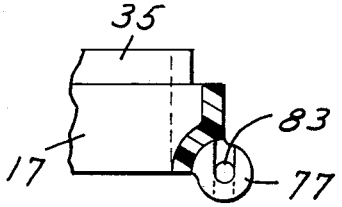
FIG. 13 is a fragmentary section taken in the direction of arrows 13—13 of FIG. 10, on an increased scale.

Each of the respective front and rear walls 13 and 15; end wall sections 17 and 19; and the bottom walls or wall sections 21 are made from a molded rigid plastic material which includes a plurality of right angularly related interconnecting ribs 37, shown on an enlarged scale in FIG. 9, to define a series of open mesh webbing over the corresponding surfaces of the respective walls and wall sections. The intersections of connected ribs 37 are reinforced by the radius portions or radii 85. Any engineered plastic material may be used which is impervious to oil and will withstand temperatures in the range of −35° to 150° F.

A series of angular rib reinforcements or braces 39 extend between some of the right angularly related ribs 37 in the walls and wall sections to improve the structural character and rigidity of the corresponding walls and wall sections. The reinforcing braces are molded as integral parts of the walls or wall sections. The positions of the braces 39 are selected to insure structural integrity of the several walls and wall sections and to prevent damage to the walls through normal use over an extended period of time.

The respective front and rear walls 13 and 15 have central legs 41 which are reinforced by braces or reinforcing ribs 39. The legs 41 are molded as an integral part of the front and rear walls. Depending from the ends of the corresponding front and rear walls 13 and 15 and formed as an integral part thereof are a pair of spaced stacking legs 43, FIG. 1. Each of the stacking legs 43 has a taper guide surface 45 terminating in a horizontal ledge 47 and a side stop 49.

Upon each of the front and rear walls 13 and 15, projecting from the upper outer edges thereof are a pair of stacking keys 51 having tapered guide surfaces 53 adapted for cooperative projection into and for supportively receiving the stacking legs 43 of an overlying shipping container 11.

Figures 5, 6:
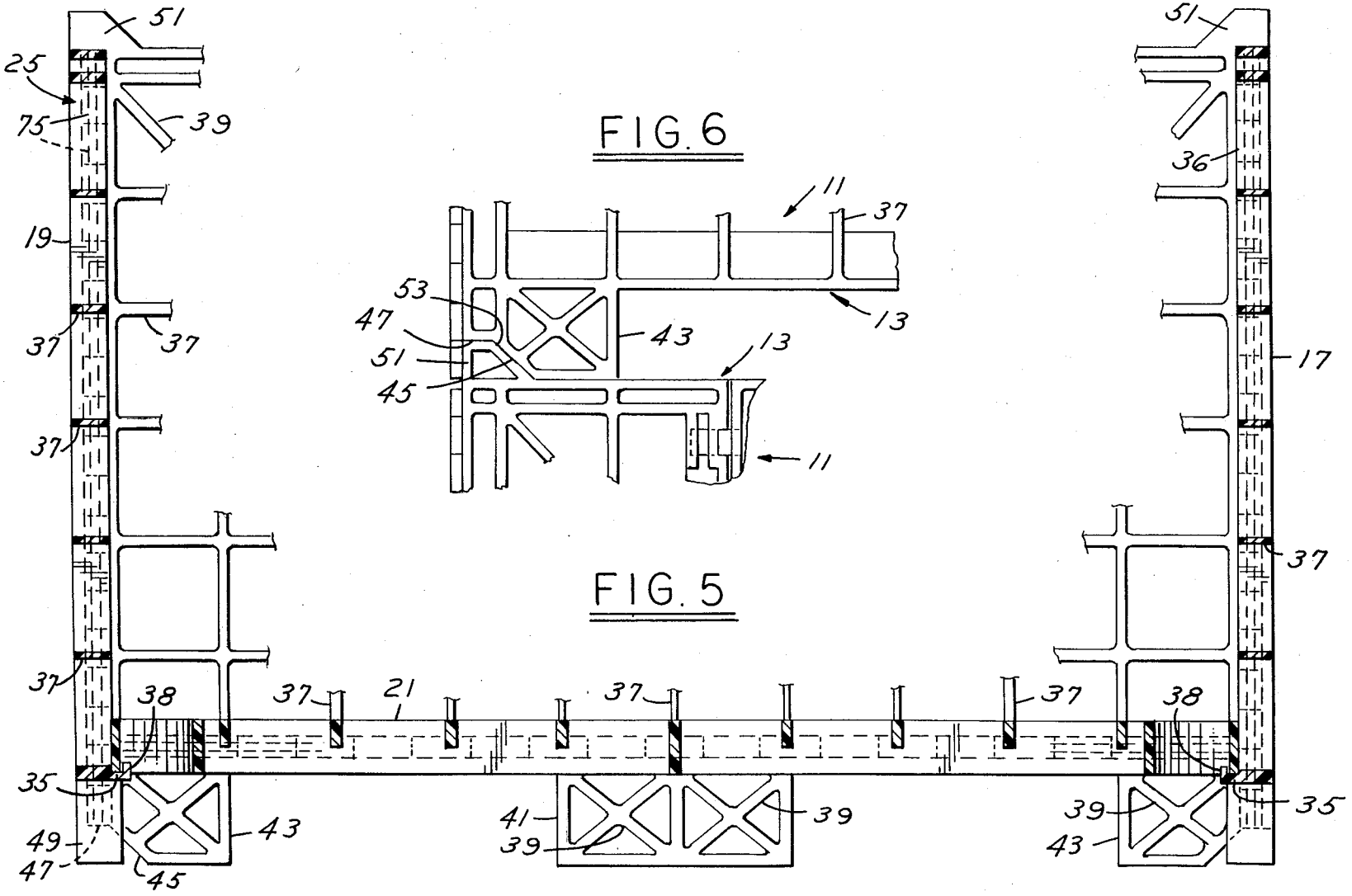
FIG. 5 is a fragmentary section taken in the direction of arrows 5—5 of FIG. 2.
FIG. 6 is a side view of a pair of stacked shipping containers, fragmentarily shown.

As illustrated in FIG. 6, the respective stacking keys 51 of a lower container 11 are adapted to snugly register within the overlying and adjacent depending legs 43 of a second shipping container 11 stacked thereover. Here the tapered surfaces 53 of the keys 51 register with the corresponding tapered surfaces 45 of the overlying container 11 and in registry with the stop ledges 47 and in lateral registry with the side stops 49. This construction, as shown fragmentarily in FIG. 6, provides a means by which two or three shipping containers when loaded may be vertically stacked and maintained in vertical alignment against accidental displacement longitudinally or transversely.

The bottom wall hinges 29, FIG. 1, includes a plurality of longitudinally spaced front wall hinge elements 53, each having a horizontal slot 55 which opens outwardly in the illustrative embodiment. There are provided at the ends of the bottom walls 21, a plurality of outwardly directed longitudinally spaced bottom wall hinge elements 57 which are adapted for interlocking alignment with hinge elements 53. The bottom wall hinge elements 57 have formed therein a series of vertical slots 59, FIG. 2. Accordingly, when the hinge elements 53 and 57 are in alignment, the slots 55 and 59 are right angularly related and are adapted to receive the elongated hinge pins 61, preferably made of steel. With this construction the respective aligned hinge elements of one wall includes slots extending in a first direction, while the aligned hinge elements of the other wall or section has slots extending in a second direction at right angles to the first direction.

Each of the front and rear wall access sections or doors 31 are hinged at 33, FIG. 1 to corresponding adjacent portions of the front and rear walls 13 and 15. Hinges 33 include upon the walls a plurality of laterally spaced wall hinge elements 63 as a part of the front or rear wall, adapted for registry with corresponding alternative longitudinally spaced hinge elements 65 provided on the bottom edge of the access doors 31, FIG. 1. The access doors 31 and front and rear walls 13 and 15 are interconnected by corresponding transverse hinge pins 67, preferably made from metal, such as steel.

Portions of the corresponding access sections 31 include manually operable latching means 68 adjacent their upper edges which removably interlock with corresponding portions of walls 13 and 15.

In the illustrative embodiment there is provided a pair of opposed outwardly directed clothes pin latches 69 which are slidably supported within latch guides 71 formed as a part of access section 31. The latches 69 are adapted for respective projection within corresponding latch keepers 73 formed as parts of the front and rear walls 13 and 15.

Figure 3:
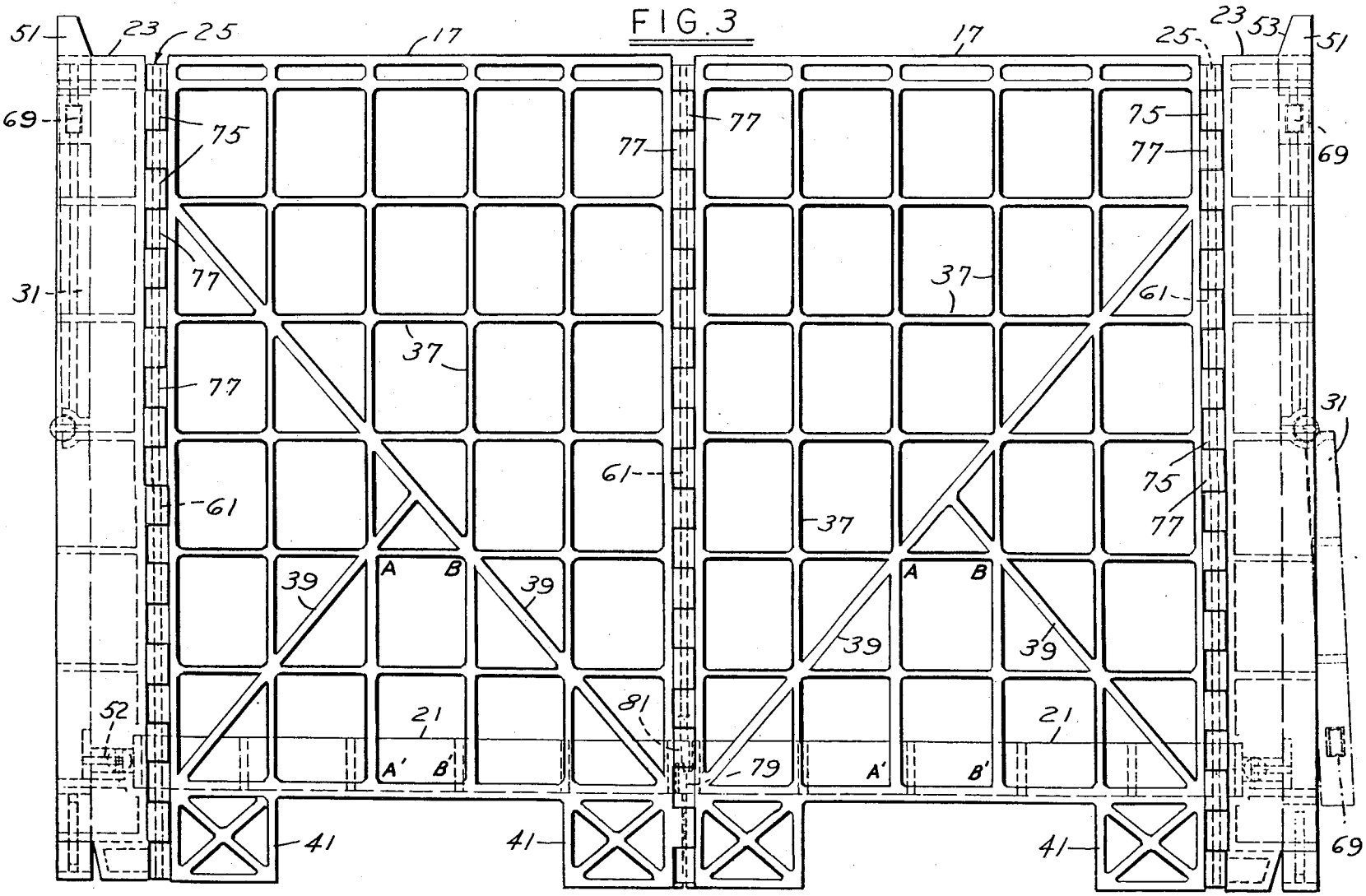
FIG. 3 is a right side elevational view of the container.

In order to release the access sections or doors 31 from the corresponding wall, all that is necessary is to manually squeeze the latches 69 together at their free ends and retract the corresponding latches 69 to permit the access section 31 to be rotated downwardly to the position shown in the dash lines at 31, FIG. 3. This provides a means by which there may be manual access to the interior of a shipping container 11 or to a series of stacked shipping containers without disassembling the stack of containers.

Each of the respective opposed corners 23 which extend at right angles to the corresponding front and rear walls 13 and 15, have formed therein a series of longitudinally spaced molded corner hinge elements 75, FIG. 3. These are adapted to receive in alignment a corresponding series of longitudinally spaced end wall hinge sections 77 molded as a part of a corresponding end wall sections 17 and 19. A suitable elongated hinge pin 61 which is preferably metallic, projects through the angularly related slots provided in the corresponding corner hinge elements 75 and end wall section hinge elements 77.

As shown in FIG. 3, the corresponding adjacent mating edges of the aligned end wall sections 17 and 19 have formed therein alternated longitudinally spaced aligned end wall section hinge elements 77. The aligned hinge elements 77 are provided with angularly related slots which receive the pivot pin 61 as shown in FIG. 3.

Upon the inner edge of one bottom wall 21 and extending transversely thereof is an upturned slotted element 79. A corresponding downturned flange element 81 extends across the inner edge of the other bottom wall 21 so that the pair of bottom walls are interlocked, as shown in FIG. 4, when the bottom walls 21 have been rotated to the downward normal position in alignment and resting upon the corresponding ledges 35 which project from the corresponding end wall sections 17 and 19.

OPERATION

The present collapsible and stackable shipping or storage container 11, in normal operative use, has its front and rear walls 13 and 15, spaced apart the maximum amount and the corresponding end wall sections 17 and 19 arranged in alignment, FIG. 3. The respective front and rear walls 13 and 15 have central support legs 41 as well as the outwardly arranged stacking legs 43.

The corresponding end wall sections 17 and 19 have at their respective outer edges the corresponding depending support legs 41 which are molded as an integral part thereof to provide proper uniform support for the loaded container 11 upon a support surface.

When two or more of the storage or shipping containers 11 are stacked vertically, such as shown fragmentarily in FIG. 6, stacking legs 43 of the upper container overlie and cooperatively receive the stacking keys 51 of the container aligned thereunder. The corresponding tapered portions 53 of the stacking keys 51 register with corresponding tapered surface portions 45 of the stacking legs 43. The top portions of the stacking keys 51 of the underlying container bear against corresponding stop portions 47 of the overlying container legs, with lateral portions of the keys 51 in engagement with end stops 49. This assures that once two or three of the containers are vertically stacked, they will be retained in alignment because of the cooperative engagement of the keys 51 of the underlying container into registry with the corresponding stacking legs and integral surfaces 43, 45, 47 and 49 of the overlying container.

The corresponding bottom walls 21 in use are rotated to horizontal position in alignment and rest upon the corresponding end wall ledges 35. The adjacent inner edges of the bottom walls 21 are overlapped and interlocked as at 79, 81, FIG. 4.

Normally the access sections or doors 31 of the front and rear walls 13 and 15 are maintained in the upright position in alignment with the corresponding wall. These access sections 31 may be pivoted downwardly 180° into engagement with the corresponding wall to permit individual access to the interior of any of the containers stacked or otherwise.

Figure 15:
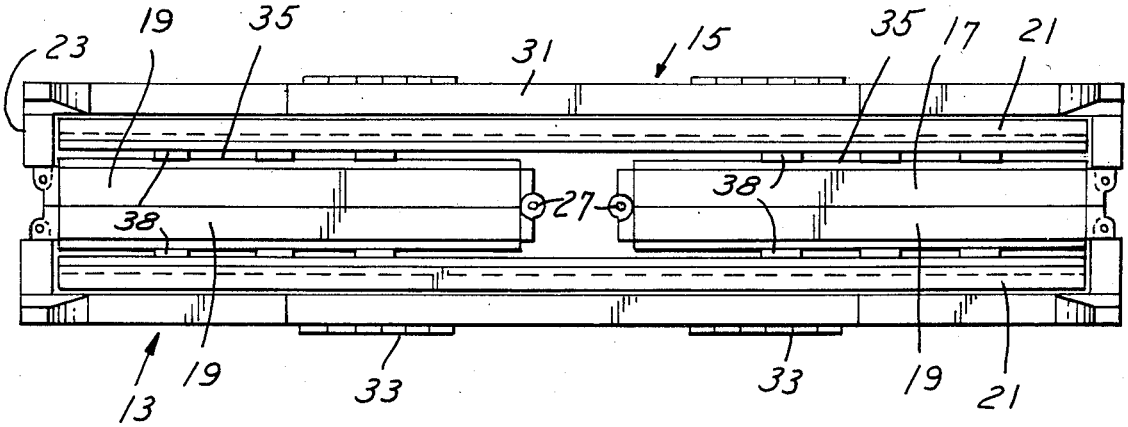
FIG. 15 is a plan view of the shipping container fully collapsed.

In order to collapse a container 11 when empty for storage or otherwise, as shown in FIGS. 4 and 14, first the respective bottom walls 21 are elevated through the dash line positions shown in FIG. 4 into upright position in engagement with the interior surfaces of the corresponding front and rear walls 13 and 15. In such upright storage position, the profile of each bottom wall 21 is within the upright corners 23 of the walls to thereby facilitate inward collapsing of the corresponding end wall sections, FIG. 14. The respective bottom walls 21 must be tilted upwardly first and thereafter the corresponding end wall sections 17 and 19 are folded inwardly, FIG. 14, with the end wall sections 17 and 19 respectively brought into engagement, FIG. 15. At the same time, the corresponding front and rear walls 13 and 15 are drawn together to provide a compact collapsed condition for the shipping or storage container 11.

When collapsed, the shipping and storage container 11 occupies a minimum of space and can be stacked as desired. In the illustrative embodiment the containers have a dimension of 44½"×48"×33", and have a capacity to carry, as an example, 1,500 to 2,500 pounds of load. When collapsed, the space occupied by the container is in a ratio of 5 to 1, when compared with non collapsable containers. When collapsed, the container 11 has a height of 9". Each container weighs 55 to 70 pounds approximately, as compared with a conventional metal or wire container weighing 225 pounds.

Therefore, the difference in weight between a metal or wire mesh container of the prior art, and the molded plastic, open grid wall or panel container of the present invention, is approximately 165 pounds. A truck may carry sixty loaded containers, and therefore, substantial savings are made in the dead weight of the containers per truck load. This has an economic effect not only in the ability of a truck to carry increased pay loads but also may result in economic gains to the truck operator in terms of tire maintenance, etc.

The present invention provides a split or two piece bottom 21, hinged on two ends. The adjacent edges of the bottom sections are interlocked and the lateral edges of the bottom sections are supported on ledges provided on the lower edge portions of the end walls or panels. The bottom walls 21 are retained in the horizontal position by the locking or retaining tabs 38.

The end walls or wall sections 17 and 19 are symmetrically opposite and may be interchanged. The front and rear walls or panels 13 and 15, including the access sections 31 are symmetrically opposite and may be interchanged. The bottom wall sections are also symmetrical in dimensions. The use of symmetrical walls or panels greatly increases the value of the container to the manufacturer, since the tool design is simplified and reduced, thereby resulting in a more economical design. The consumer also benefits in that fewer replacement panels or walls are required and the modular walls or panels can be replaced when damaged by removing the pivot pins, inserting the new panel and reinserting the pivot pins.

The container 11 is made from a plastic material, except for the eight long pivot pins and the four short pivot pins, which are preferably made from steel, although, in certain applications, plastic pivot pins may be used. The use of pivot pins permit for easy removal of same in order to replace damaged walls or panels or sections rapidly and efficiently.

In order to provide a lightweight plastic structure or container 11 and one with sufficient structural strength, the various panels may include ribs of different dimensions.

In FIG. 1, the vertical ribs 37, having the vertical coordinates A–A' to E–E' and the horizontal ribs 37, having the horizontal coordinates 1–1' to 2–2', each have a depth of 1.125" and a thickness of 0.188". The ribs 37, outside of the specified coordinates, each has a depth of 1.125" and a thickness of 0.250".

In FIG. 2, the ribs of the bottom walls 21, each has the same thickness of 0.250". The peripheral ribs 37, diagonal ribs 39 and the ribs having the vertical coordinates A–A' to E–E' and the horizontal coordinates 1–1' and 6–6', each has a depth of 2" while the other ribs each has a depth of 1".

In FIG. 3, the end wall sections 17 and 19, including the legs 41, have ribs with the same depth, each of 1.125". The peripheral ribs, the several diagonal ribs 39, the ribs 37, defined by the vertical coordinates A–A' to B–B', and the ribs of the legs 41, each has a thickness of 0.250". The remaining horizontal and vertical ribs, each has a thickness of 0.188".

In FIGS. 1 and 7, the access wall sections or doors 31, include a pair of vertical and a pair of horizontal peripheral ribs, forming the outer frame thereof. Such peripheral ribs have a depth of 1.230" and a thickness of 0.250". The remaining internal ribs of the doors 31, each has a depth of 0.750" and a thickness of 0.188".

Having described my invention, reference should now be had to the following claims:

I claim:

1. A collapsible stackable lightweight shipping container having an open top comprising front and rear walls;

opposed sectional end walls, each end wall including a pair of aligned end wall sections pivotally interconnected along their inner adjacent upright edges and a their outer upright edges pivotally connected to opposite side edges of said front and rear walls respectively;

a corner member of L-shape configuration located upon and along the outer upright edges of said front and rear walls, each corner member forming a part of the front or rear wall to which it is connected and extending inwardly at right angles thereto;

a pair of aligned bottom walls at their outer edges pivotally connected to bottom edges of said front and rear walls respectively and at their opposite sides supported upon said end walls respectively;

said bottom walls adapted for upward pivoting into engagement with said front and rear walls respectively;

said end wall sections adapted for inward pivotal movement into parallel engagement with each other and with the front and rear walls and the lifted bottom walls;

said bottom walls being enclosed by the corresponding corner members when collapsed to facilitate inward folding and collapsing of said end wall sections;

said front, rear and bottom walls and said end wall sections being made from molded plastic material and having inner and outer surfaces;

each wall and section including a plurality of spaced right angularly related ribs defining an open mesh construction between the inner and outer surfaces throughout substantially the entire area of each wall and section;

said front wall having a central rectangular opening adjacent its upper edge;

an upright front wall access section made from molded plastic material and having inner and outer surfaces, said section being nested within said opening coplanar with said front wall, along its lower edge pivotally connected to said front wall;

said front access section including a plurality of spaced right angularly related ribs defining an open mesh construction between the inner and outer surfaces thereof; and opposed outwardly directed latch means slidably mounted upon upper side portions of said access section aligned with and retainingly engageable with corresponding detents said front wall.

2. In the shipping container of claim 1, each of the connected walls and sections respectively having cooperating aligned spaced hinge elements formed as integral parts thereof; and pivot pins interconnecting the respective hinge elements.

3. In the shipping container of claim 2, each of the respective aligned hinge elements of one wall including slots extending in a first direction, each of the aligned hinge elements of the adjacent pivotally connected wall and section having slots extending in a second direction at an angle to said first direction to retain the corresponding pivot pin.

4. In the shipping container of claim 3, the slots in each hinge element of one wall opening inwardly and outwardly alternately, the slots in the adjacent wall and section opening inwardly and outwardly alternately.

5. In the shipping container of claim 1, each of the front and rear walls at their ends having integral depending legs, each leg being formed with a taper guide, a ledge and a laterally displaced stop;

each of the front and rear walls at their ends having integral upstanding stacking keys having a tapered guide; and a second shipping container overlying the first mentioned shipping container, with its depending legs, tapered guides, edges and stops in cooperating retained nesting registry with the corresponding upstanding stacking keys of said first container.

6. In the shipping container of claim 1, the pivotal connection between said front wall and access section including opposed spaced aligned hinge elements with said front wall and access section respectively; and a pivot pin interconnecting said hinge elements.

7. In the shipping container of claim 1, said rear wall having a central rectangular opening adjacent its upper edge;

an upright access section made from molded plastic material and having inner and outer surfaces, said section being nested within said opening, along its lower edge pivotally connected to said rear wall;

said front access section including a plurality of spaced right angularly related ribs defining an open mesh construction between the inner and outer surfaces thereof; and opposed outwardly directed latch means slidably mounted upon upper side portions of said latter access section algined with and retainingly engagable with corresponding detents in said rear wall.

8. A collapsible stackable lightweight shipping container having an open top comprising front and rear walls;

opposed sectional end walls, each end wall including a pair of aligned end wall sections pivotally interconnected along their inner adjacent upright edges and at their outer upright edges pivotally connected to opposite side edges of said front and rear walls respectively;

a corner member of L-shape configuration located upon and along the outer upright edges of said front and rear walls, each corner member forming a part of the front or rear wall to which it is connected and extending inwardly at right angles thereto;

a pair of aligned bottom walls at their outer edges pivotally connected to bottom edges of said front and rear walls respectively and at their opposite sides supported upon said end walls respectively;

said bottom walls adapted for upward pivoting into engagement with said front and rear walls respectively;

said end wall sections adapted for inward pivotal movement into parallel engagement with each other and with the front and rear walls and the lifted bottom walls;

said bottom walls being enclosed by the corresponding corner members when collapsed to facilitate inward folding and collapsing of said end wall sections;

said front, rear and bottom walls and said end wall sections being made from molded plastic material and having inner and outer surfaces;

each wall and section including a plurality of spaced right angularly related ribs defining an open mesh construction between the inner and outer surfaces throughout substantially the entire area of each wall and section;

opposed aligned ledges extending inwardly from lower edges of said end wall sections;

said bottom walls resting upon and supported by said ledges;

there being a transversely extending upwardly opening slotted element along the inner edge of one bottom wall;

and a corresponding downwardly extending flange element along the inner edge of the other bottom wall, nested within said slotted element.

9. In the shipping container of claim 8, said opposed aligned ledges having a plurality of upstanding retaining tabs which are received in openings provided in the corresponding bottom walls when resting upon said ledges.

10. In the shipping container of claim 1, there being a reinforcing radius between said right angularly related ribs defining said open mesh construction.

11. In the shipping container of claim 1, said walls and said wall sections being modular and symmetrical respectively, whereby any thereof, if damaged may be guidably replaced by removal of pivot pins only.

12. A collapsible stackable lightweight shipping container having an open top comprising front and rear walls;

opposed sectional end walls, each end wall including a pair of aligned end wall sections pivotally interconnected along their inner adjacent upright edges and at their outer upright edges pivotally connected to opposite side edges of said front and rear walls respectively;

a pair of aligned bottom walls at their outer edges pivotally connected to bottom edges of said front and rear walls respectively and at their opposite sides supported upon said end walls respectively;

said bottom walls adapted for upward pivoting into engagement with said front and rear walls respectively;

said end wall sections adapted for inward pivotal movement into parallel relationship with each other and with said front and rear walls and said lifted bottom walls;

said front, rear and bottom walls and said end wall sections being made from molded plastic material and having inner and outer surfaces;

each wall and section including a plurality of spaced right angularly related ribs defining an open mesh construction between the inner and outer surfaces thereof;

each of said connected walls and sections respectively having cooperating aligned spaced hinge elements formed as integral parts thereof;

pivot pins interconnecting the respective hinge elements of said connected walls and sections;

one of said front and rear walls having a central rectangular opening adjacent its upper edge;

an upright wall access section made from molded plastic material and having inner and outer surfaces, said access section being nested within said central opening coplanar with said one wall and along its lower edge being pivotally connected to said one wall;

said access section including a plurality of spaced right angularly related ribs defining an open mesh construction between the inner and outer surfaces thereof;

opposed outwardly directed latch means slidably mounted upon upper side portions of said access section aligned with and retainingly engagable with corresponding detents upon said one wall;

the pivotal connection between said one wall and access section including opposed spaced aligned hinge elements integral with said one wall and said access section respectively;

a corner member of L-shape configuration upon and along the outer upright edges of said front and rear walls extending inwardly at right angles thereto;

said bottom walls when collapsed upwardly to engage said front and rear walls respectively being enclosed by the corresponding corner members facilitating inward folding and collapsing of said end wall sections;

opposed aligned ledges extending inwardly from lower edges of said end wall sections;

said bottom walls when extended resting upon and supported by said ledges;

a transversely extending upwardly opening slotted element provided in the inner edge of one bottom wall; and a corresponding downwardly extending flange element along the inner edge of the other bottom wall for nesting within said slotted element when the bottom walls are extended.

13. In the shipping container of claim 12, each of the front and rear walls at their ends having integral depending legs, each leg being formed with a taper guide, a ledge and a laterally displaced stop;

each of the front and rear walls at their ends having integral upstanding stacking keys having a tapered guide; and a second shipping container overlying the first mentioned shipping container, with its depending legs, tapered guides, edges and stops in cooperating retained nesting registry with the corresponding upstanding stacking keys of said first container.

14. In the shipping container of claim 12, each of the front and rear walls having depending legs at their ends and intermediate their ends, each of said end wall sections having depending legs adjacent their inner and outer upright edges, said legs being integral with said walls and sections respectively.

15. In the shipping container of claim 12, there being a reinforcing radius between said right angularly related ribs defining said open mesh construction.

16. In the shipping container of claim 12, said walls and said wall sections being modular and symmetrical respectively, whereby any thereof, if damaged may be guidably replaced by removal of pivot pins only.

17. In the shipping container of claim 12, each of the respective aligned hinge elements of one wall including slots extending in a first direction, each of the aligned hinge elements of the adjacent pivotally connected wall and section having slots extending in a second direction at an angle to said first direction to retain the corresponding pivot pin.

18. In the shipping container of claim 17, the slots in each hinge element of one wall opening inwardly and outwardly alternately, the slots in the adjacent wall and section opening inwardly and outwardly alternately.

* * * * *